US006963263B1

(12) United States Patent
Cook et al.

(10) Patent No.: US 6,963,263 B1
(45) Date of Patent: Nov. 8, 2005

(54) NON-CONTACT ELECTRICAL ENERGY TRANSFER SYSTEM

(75) Inventors: Hugh C. Cook, Lynn Haven, FL (US); Stephen M. Mahan, Lynn Haven, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 163 days.

(21) Appl. No.: 10/699,427

(22) Filed: Nov. 3, 2003

(51) Int. Cl.[7] ..... H01F 17/06
(52) U.S. Cl. ..... 336/178; 336/212; 336/117
(58) Field of Search ..... 336/212, 178, 336/130–134, 115, 117; 29/602.1, 606

(56) References Cited

U.S. PATENT DOCUMENTS 5,376,912 A * 12/1994 Casagrande ..... 336/178
5,506,764 A * 4/1996 Hon et al. ..... 363/21.16
6,417,753 B1 * 7/2002 Wolf et al. ..... 336/182
6,737,951 B1 * 5/2004 Decristofaro et al. ..... 336/234
6,781,496 B2 * 8/2004 Kobayashi et al. ..... 336/107
6,873,239 B2 * 3/2005 Decristofaro et al. ..... 336/178

* cited by examiner

*Primary Examiner*—Anh Mai
(74) *Attorney, Agent, or Firm*—James T. Shepherd

(57) ABSTRACT

A non-contact electrical energy transfer system has a nearly continuous loop of ferromagnetic material that defines a gap. A first electric conductor is coiled about a portion of the nearly continuous loop that opposes the gap. A block of the same ferromagnetic material is sized to loosely fit in the gap while being spaced apart from each of the opposing surfaces defining the gap. A second electric conductor is coiled about the block. Electrical energy applied to the first electric conductor induces an electric current in the second electric conductor when the block is positioned in the gap.

20 Claims, 2 Drawing Sheets

NON-CONTACT ELECTRICAL ENERGY TRANSFER SYSTEM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to energy transfer, and more particularly to a system that transfers electrical energy between two entities without requiring contact therebetween.

BACKGROUND OF THE INVENTION

Electrical energy transfer between a source and a user has traditionally required some form of a hardwire connection or coupling in which physical contact is made between two conductors. However, there are many instances where such connections/couplings are difficult to design and make. For example, the hardwire coupling of an electrical energy source to a load in certain harsh environments (e.g., underwater, space, hostile air environments, etc.) generally requires complex and costly couplings to insure that such couplings are environmentally sealed before, during, and after the use thereof.

SUMMARY OF THE INVENTION

Accordingly, it is an object of the present invention to provide a system and method that transfers electrical energy between two conductors without requiring any physical contact therebetween.

Another object of the present invention is to provide a system and method of non-contact electrical energy transfer that can function in a variety of environments to include air, water and space.

Other objects and advantages of the present invention will become more obvious hereinafter in the specification and drawings.

In accordance with the present invention, a non-contact electrical energy transfer system has a ferromagnetic material formed into a nearly continuous loop that defines a gap between two opposing surfaces of the ferromagnetic material. A first electric conductor is coiled about a portion of the nearly continuous loop that opposes the gap. A block of the same ferromagnetic material is sized to loosely fit in the gap while being spaced apart from each of the opposing surfaces formed by the nearly continuous loop. A second electric conductor is coiled about a portion of the block. The block is spaced apart from the opposing surfaces when the block is fitted in the gap. Electrical energy applied to the first electric conductor induces an electric current in the second electric conductor when the block is positioned in the gap.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
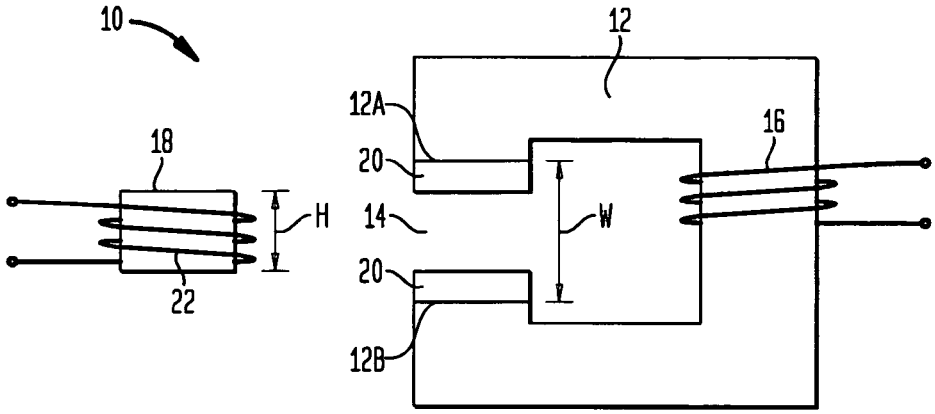
FIG. 1 is a schematic view of a non-contact electrical energy transfer system illustrated in a non-energy transfer mode in accordance with the present invention.
Figure 2:
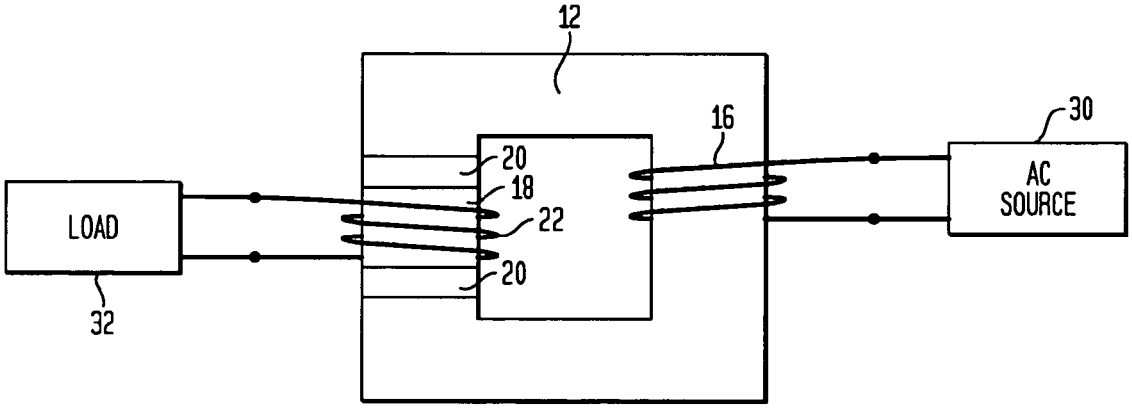
FIG. 2 is a schematic view of the non-contact electrical energy transfer system in an energy transfer mode.

Referring now to the drawings, and more specifically to FIGS. 1 and 2, a non-contact electrical energy transfer system in accordance with the present invention is shown and is referenced generally by numeral 10. It is to be understood at the outset that energy transfer system 10 can operate in an air, water or space environment. By way of an illustrative example, one use of transfer system 10 will be described below as it relates to use in a water environment.

Energy transfer system 10 has a core 12 of a ferromagnetic material (i.e., iron, nickel, etc.) that is shaped to define a nearly continuous loop. That is, core 12 is discontinuous such that a gap 14 of width W is defined between ends 12A and 12B of core 12. Although the shape formed by core 12 is not a limitation of the present invention, core 12 is illustrated as a C-shaped core to take advantage of simple iron core transformer concepts. Accordingly, coiled about core 12 at a region thereof that opposes gap 14 is an electrical conductor 16 (e.g., wire, strip of material, a conductive run of material adhered to core 12, etc.).

Energy transfer system 10 further includes a block 18 of the same ferromagnetic material used for core 12. Preferably, the cross-sectional area of block 18 matches the surface area of each of ends 12A and 12B. Block 18 is sized such that its height H is less than width W. The amount of difference between these two dimensions should provide for a small space between block 18 and each of ends 12A and 12B when block 18 is positioned in gap 14 as will be explained further below. To maintain such spacing between block 18 and ends 12A and 12B, a sleeve 20 can be provided in gap 14 where cross-sectional area of sleeve 20 is configured/sized to slidingly receive block 18. Sleeve 20 would typically be made from an electrically insulating material such as rubber, nylon, plastic or glass. Coiled about block 18 is an electric conductor 22 (e.g., wire, strip, a conductive run of material adhered to block 18, etc.).

When electrical energy transfer between conductors 16 and 22 is desired, block 18 is positioned in the gap (i.e., gap 14 illustrated in FIG. 1 but not shown in FIG. 2 for sake of clairty) by sleeve 20 as shown in FIG. 2. With block 18 so positioned, electrical energy (e.g., an AC voltage) is applied to electric conductor 16 by an AC source 30. The resulting alternating current that passes through electric conductor 16 induces a magnetic field in core 12. The magnetic field flux lines are concentrated by core 12 as is well understood in the transformer field. The lines of flux pass through the windings of electric conductor 22 thereby inducing an electric current in conductor 22 that is supplied to a load 32. Electrical energy transfer will occur regardless of whether gap 14 is in an air, water or space environment. The inclusion of insulating sleeve 20 prevents any arcing from occurring if AC source 30 is activated while block 18 is being positioned in sleeve 20.

Figure 3:
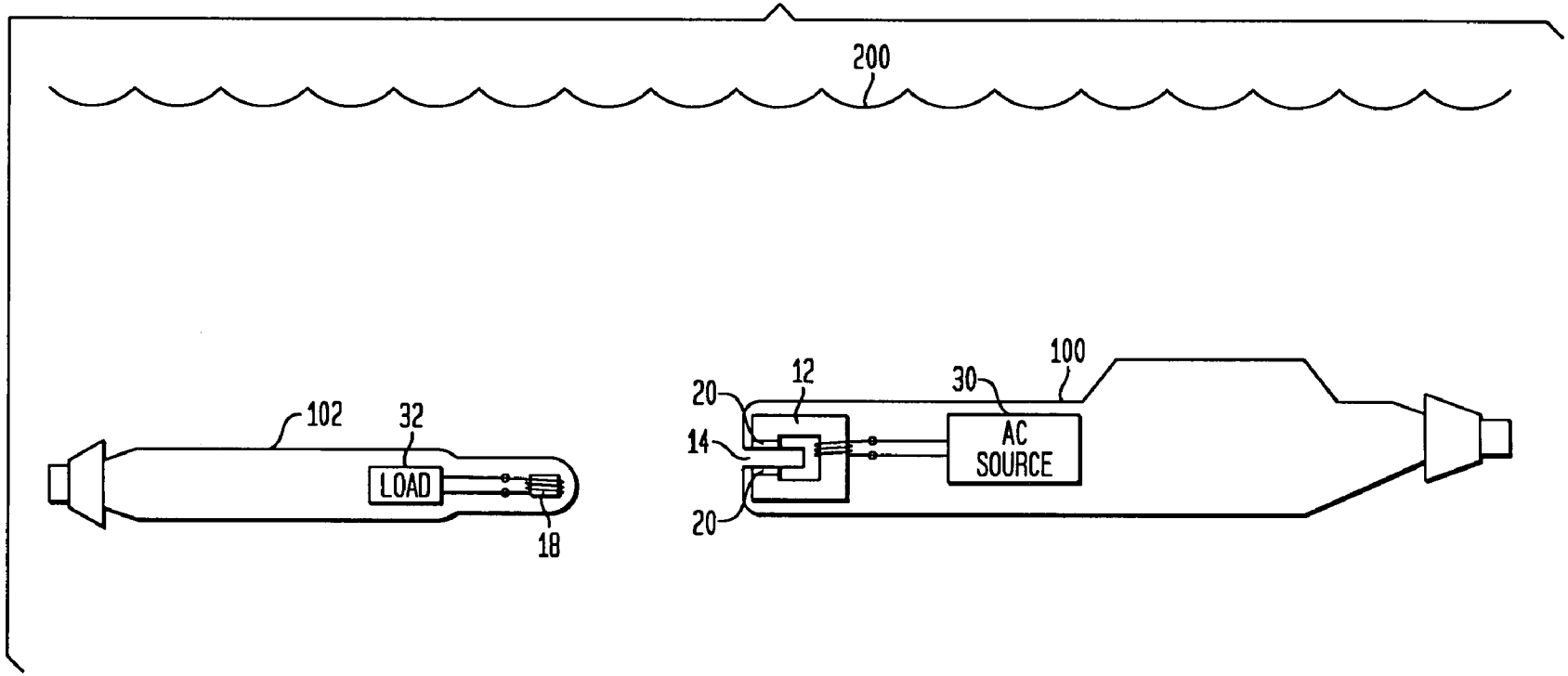
FIG. 3 is a schematic view of one embodiment of the non-contact electrical energy transfer system used to transfer electrical energy from a submersible vehicle to an underwater vehicle in a water environment.

The advantages of the present invention are numerous. Electrical energy transfer between two conductors is facilitated without requiring any direct physical contact between the conductors. The present invention simplifies electrical energy transfer in a variety of environments and can, therefore, be adapted for a wide variety of applications. For example, as illustrated in FIG. 3, the present invention simplifies electrical energy transfer between a submersible vehicle 100 and an underwater vehicle 102. Specifically, submersible vehicle 100 has core 12 mounted thereon such that gap 14 is submerged in water 200 and accessible from water 200. Underwater vehicle 102 has block 18 mounted thereon (e.g., extended from the nose thereof as shown) such that block 18 can be inserted into sleeve 20 and gap 14. The particular mounting sleeve used for block 18 is not a limitation of the present invention. AC source 30 on submersible vehicle 100 can be, for example, an onboard AC generator while load 32 (on underwater vehicle 102) can be a battery charging system, the choice of which is not a limitation of the present invention.

Although the invention has been described relative to a specific embodiment thereof, there are numerous variations and modifications that will be readily apparent to those skilled in the art in light of the above teachings. For example, the present invention is not limited to energy transfer between underwater vehicles as it can be used equally as well for vehicles that operate in air or space environments. Furthermore, the present invention is not limited to electrical energy transfer between vehicles as it can be used equally as well for electrically coupling stationary systems such as electrical cables. It is therefore to be understood that, within the scope of the appended claims, the invention may be practiced other than as specifically described.

What is claimed as new and desired to be secured by Letters Patent of the United States is:

1. A non-contact electrical energy transfer system, comprising:

a ferromagnetic material formed into a nearly continuous loop wherein a gap is formed between two opposing surfaces of said ferromagnetic material;

a first electric conductor coiled about a portion of said ferromagnetic material formed into said nearly continuous loop, said portion opposing said gap;

a block of said ferromagnetic material sized to loosely fit in said gap while being spaced apart from each of said opposing surfaces;

a second electric conductor coiled about a portion of said block, wherein electrical energy applied to said first electric conductor induces an electric current in said second electric conductor when said block is positioned in said gap; and means for keeping said block spaced apart from said opposing surfaces when said block is fitted in said gap.

2. A non-contact electrical energy transfer system as in claim 1 wherein said means for keeping is a sleeve positioned in said gap.

3. A non-contact electrical energy transfer system as in claim 1 wherein said means for keeping is an electrically insulating material interposed between each of said opposing surfaces and said block.

4. A non-contact electrical energy transfer system as in claim 3 wherein said electrically insulating material is selected from the group consisting of rubber, nylon, plastic and glass.

5. A non-contact electrical energy transfer system as in claim 1 wherein said ferromagnetic material is iron.

6. A non-contact electrical energy transfer system as in claim 1 further comprising a vehicle on which said ferromagnetic material formed into said nearly continuous loop is mounted such that said gap is accessible from a position outside of said vehicle, said vehicle having an AC power source coupled to said first electric conductor for applying said electrical energy thereto.

7. A non-contact electrical energy transfer system as in claim 6 wherein said vehicle is a submersible vehicle.

8. A non-contact electrical energy transfer system as in claim 7 further comprising an underwater vehicle on which said block is mounted.

9. A non-contact electrical energy transfer system as in claim 8 further comprising means mounted onboard said underwater vehicle and coupled to said second electric conductor for receiving said electric current so-induced therein.

10. A non-contact electrical energy transfer system, comprising:

a C-shaped core of a ferromagnetic material having two opposing end faces with a gap defined therebetween;

a first electric conductor coiled about a portion of said C-shaped core that opposes said gap;

a block of said ferromagnetic material sized to loosely fit in said gap while being spaced apart from each of said opposing end faces;

a second electric conductor coiled about at least a portion of said block, wherein electrical energy applied to said first electric conductor induces an electric current in said second electric conductor when said block is positioned in said gap; and electrically insulating material disposed in said gap to keep said block spaced apart from each of said opposing end faces when said block is fitted in said gap.

11. A non-contact electrical energy transfer system as in claim 10 wherein each of said opposing end faces of said C-shaped core is covered with said electrically insulating material.

12. A non-contact electrical energy transfer system as in claim 10 wherein said electrically insulating material is selected from the group consisting of rubber, nylon, plastic and glass.

13. A non-contact electrical energy transfer system as in claim 10 wherein said ferromagnetic material is iron.

14. A non-contact electrical energy transfer system as in claim 10 further comprising a vehicle on which said C-shaped core is mounted such that said gap is accessible from a position outside of said vehicle, said vehicle having an AC power source coupled to said first electric conductor for applying said electrical energy thereto.

15. A non-contact electrical energy transfer system as in claim 14 wherein said vehicle is a submersible vehicle.

16. A non-contact electrical energy transfer system as in claim 15 further comprising an underwater vehicle on which said block is mounted.

17. A non-contact electrical energy transfer system as in claim 16 further comprising an electrical load mounted onboard said underwater vehicle and coupled to said second electric conductor.

18. A non-contact method of transferring electrical energy, said method comprising the steps of;

providing a ferromagnetic material formed into a nearly continuous loop wherein a gap is defined therein with two opposing surfaces of said ferromagnetic material defining the ends of said gap, said ferromagnetic material having a first electric conductor coiled thereabout at a region thereof that opposes said gap;

providing a block of said ferromagnetic material sized to loosely fit in said gap while being spaced apart from each of said opposing surfaces, said block having a second electric conductor coiled thereabout;

inserting said block with said second electric conductor coiled thereabout into said gap while keeping said block spaced apart from each of said opposing surfaces; and applying electrical energy to said first electric conductor when said block is in said gap, wherein an electric current is induced in said second electric conductor.

19. A method according to claim 18 wherein said electrical energy so-applied is an AC voltage.

20. A method according to claim 18 wherein said step of inserting occurs with said gap and said block being submerged in water, said method further comprising the step of electrically insulating each of said opposing surfaces from said block.

* * * * *